US011913666B2

(12) United States Patent
Qin

(10) Patent No.: US 11,913,666 B2
(45) Date of Patent: Feb. 27, 2024

(54) AIR CONDITIONER INDOOR UNIT AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Qiang Qin, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 1147 days.

(21) Appl. No.: 16/677,063

(22) Filed: Nov. 7, 2019

(65) Prior Publication Data

US 2020/0208869 A1 Jul. 2, 2020

Related U.S. Application Data

(63) Continuation of application No. PCT/CN2019/109138, filed on Sep. 29, 2019.

(30) Foreign Application Priority Data

Dec. 29, 2018 (CN) ..... 201822277388.6

(51) Int. Cl.
*F24F 13/02* (2006.01)
*F24F 1/0314* (2019.01)

(52) U.S. Cl.
CPC ..... *F24F 13/029* (2013.01); *F24F 1/0314* (2019.02); *F24F 13/0245* (2013.01); *F24F 2221/22* (2013.01)

(58) Field of Classification Search
CPC .... F24F 13/029; F24F 1/0314; F24F 13/0245; F24F 1/0011; F24F 1/0003; F24F 1/0068; F24F 1/0057
See application file for complete search history.

(56) References Cited

U.S. PATENT DOCUMENTS 3,277,663 A * 10/1966 Ulich ..... F24F 13/20 62/262
2008/0022700 A1* 1/2008 Katsuyama ..... F24F 1/0003 62/77

(Continued)

FOREIGN PATENT DOCUMENTS

CN 107388374 A 11/2017
CN 107388385 A 11/2017

(Continued)

OTHER PUBLICATIONS

World Intellectual Property Organization (WIPO) International Search Report and Written Opinion for PCT/CN2019/109138 with translation dated Jan. 2, 2020 21 Pages.

(Continued)

*Primary Examiner* — David J Teitelbaum
(74) *Attorney, Agent, or Firm* — Anova Law Group, PLLC

(57) ABSTRACT

An air conditioner indoor unit includes a housing, an air duct assembly mounted in the housing, and a lower panel. The housing includes a face frame. An opening is formed at a lower portion of the face frame. The lower panel includes an air outlet in communication with the air duct assembly. A periphery of the lower panel is detachably connected with an edge of the opening or the air duct assembly, and the opening is configured to expose the air duct assembly when the lower panel is opened.

20 Claims, 14 Drawing Sheets

(56) References Cited

U.S. PATENT DOCUMENTS

| | | | | |
|---|---|---|---|---|
| 2012/0135674 | A1* | 5/2012 | Uehara | F24F 13/20 454/338 |
| 2015/0027660 | A1* | 1/2015 | Cho | F24F 1/0007 165/53 |
| 2015/0300678 | A1* | 10/2015 | Niimura | F24F 13/20 454/284 |
| 2016/0025357 | A1* | 1/2016 | Suzuki | F24F 1/0018 165/121 |
| 2016/0363328 | A1* | 12/2016 | Okamoto | F24F 13/30 |
| 2017/0138613 | A1* | 5/2017 | Bai | F24F 1/0047 |
| 2018/0119984 | A1* | 5/2018 | Cho | F24F 1/0011 |
| 2022/0042715 | A1* | 2/2022 | Shin | F24F 13/22 |

FOREIGN PATENT DOCUMENTS

| | | | |
|---|---|---|---|
| CN | 206626684 | U | 11/2017 |
| CN | 107420987 | A | 12/2017 |
| CN | 107490073 | A | 12/2017 |
| CN | 206755349 | U | 12/2017 |
| CN | 206817722 | U | 12/2017 |
| CN | 206905122 | U | 1/2018 |
| CN | 207094789 | U | 3/2018 |
| CN | 207407442 | U | 5/2018 |
| CN | 208059068 | U | 11/2018 |
| CN | 209263310 | U | 8/2019 |
| EP | 2469194 | A1 | 6/2012 |
| EP | 2980503 | A1 | 2/2016 |
| EP | 3315871 | A2 | 5/2018 |
| JP | 2004245571 | A | 9/2004 |
| JP | 2009115348 | A | 5/2009 |
| JP | 2017044411 | A | 3/2017 |

OTHER PUBLICATIONS

Intellectual Property Korea (IPK) The Office Action for KR Application No. 10-2019-7033714 dated Oct. 27, 2020 13 Pages (Translation Included ).

World Intellectual Property Organization (WIPO) International Search Report for PCT/CN2019/109138 dated Sep. 29, 2019 21 Pages(Translation Included).

Intellectual Property Korea (IPK) The Second Office Action for KR Application No. 10-2019-7033714 dated May 26, 2021 14 Pages (Translation Included ).

Japan Patent Office Reasons for Refusal for Japanese Application No. 2019561850 dated Apr. 27, 2021 10 Pages (including English translation).

The European Patent Office (EPO) Extended Search Report for EP Application No. 19795074.4 dated Jun. 26, 2020 8 Pages.

* cited by examiner

A-A

D-D

E-E

AIR CONDITIONER INDOOR UNIT AND AIR CONDITIONER

CROSS-REFERENCE TO RELATED APPLICATIONS

This application is a continuation of PCT Application No. PCT/CN2019/109138, filed on Sep. 29, 2019, which claims priority to China Patent Application No. 201822277388.6, entitled "Air Conditioner Indoor Unit and Air Conditioner," filed on Dec. 29, 2018, the entire contents of both of which are incorporated herein by reference.

TECHNICAL FIELD

The present disclosure relates to the technical field of air conditioning equipment and, in particular, to an air conditioner indoor unit and an air conditioner using the indoor unit.

BACKGROUND

The housing of traditional wall-mounted air conditioner which faces the air duct assembly is normally designed as a nondetachable structure. Dust could accumulate on the wall of the air duct assembly and the cross-flow fan after the air conditioner has been used for a long time. And it is almost impossible to have a space for cleaning the air duct assembly without removing the front frame of the air conditioner. In addition, it is also inconvenient for replacing and repairing the motor of the air guiding structure.

SUMMARY

The main objective of the present disclosure is to provide an air conditioner indoor unit, aiming to improve the convenience in cleaning the indoor unit.

In order to achieve the above objective, the indoor unit proposed in the present disclosure includes:

- a housing including a face frame and a chassis connected with a rear portion of the face frame, the lower portion of the face frame is configured with an opening;
- an air duct assembly mounted at the chassis and exposed from the opening; and
- a lower panel including an air outlet in communication with the air duct assembly, a periphery portion of the lower panel is detachably connected with an edge of the opening or the air duct assembly, and a periphery of the air outlet of the lower panel is connected with the air duct assembly by a screw.

Optionally, sides of the lower panel in the front-rear direction are connected with side edges of the opening, respectively, or connected with an edge of the air duct assembly, by a connection mode that includes at least one selected from a group consisting of snap-fit, slider-slot fit, and slot-plug fit.

Optionally, a rear side of the lower panel is provided with an insertion member. The edge of the opening adjacent to a rear side of the chassis includes an insertion hole. The insertion member is fitted in the insertion hole when the opening is closed by the lower panel.

Optionally, an inner wall surface of a front side of the lower panel includes a buckle hole. The face frame or the air duct assembly comprises a buckle corresponding to the buckle hole. The buckle is fitted in the buckle hole when the opening is closed by the lower panel.

Optionally, the inner wall surface of the front side of the lower panel is protruded with two clamping plates arranged at interval, and the two clamping plates enclose to form the buckle hole. The face frame or the air duct assembly is protruded with two support platforms arranged at interval. The buckle is connected with top ends of the two support platforms.

Optionally, each of the two clamping plates is in a plate shape, and the two clamping plates are parallel to each other, and a first surface of one clamping plate and a second surface of the other clamping plate facing the first surface each include a groove, and the two clamping plate enclose to form the round buckle hole.

Optionally, a side of the lower panel in the front-rear direction is connected with the side edge of the opening or the side edge of the air duct assembly by a screw. Another side of the lower panel in the front-rear direction is connected with another side edge of the opening or another side edge of the air duct assembly by slot-plug fit.

Optionally, the air conditioner indoor unit further includes a locking member. An inner wall surface of a front side of the lower panel includes a first bolt hole. The face frame is protruded with a column including a second bolt hole. The locking member penetrates through the first bolt hole and the second bolt hole.

Optionally, a rear side of the lower panel is provided with the insertion member protruding from an inner wall surface of the lower panel and inclined rearwards, and an end of the insertion member is bent rearwards. The edge of the opening includes the insertion hole extending in the front-rear direction, and an opening of the insertion hole faces downwards. The insertion member is inserted in the insertion hole to limit the lower panel from moving along the up-down direction.

Optionally, one of a middle portion of the lower panel in the front-rear direction and a middle portion of the edge of the opening in the front-rear direction includes a clamping hole, and another one of the middle portion of the lower panel and the middle portion of the edge of the opening includes a fastener matching the clamping hole. Alternatively, one of the middle portion of the lower panel and the middle portion of the edge of the opening includes a buckle, and another one of the middle portion of the lower panel and the middle portion of the edge of the opening includes a buckle hole matching the buckle.

Optionally, the middle portion of the lower panel in the front-rear direction is protruded with two vertical plates facing with each other, and a first surface of one vertical plate faces a second surface of the other vertical plate to form the clamping hole. The middle portion of the edge of the opening in the front-rear direction includes a clamping groove. The fastener has a bar shape and is connected with a sidewall of the clamping groove. The vertical plates are inserted in the clamping groove and the fastener is inserted in the clamping hole.

Optionally, the air conditioner indoor unit further includes a plurality of locking members. A periphery of the air outlet of the lower panel includes a plurality of first screw holes. The air duct assembly includes a plurality of second screw holes. Each of the plurality of locking members penetrates through one corresponding first screw hole and one corresponding second screw hole.

Optionally, a rear side of the lower panel abuts against the chassis or is coplanar with an outer wall surface of the chassis.

Optionally, the air conditioner indoor unit further includes a heat exchanger mounted in the housing and a refrigerant pipe connected with the heat exchanger and comprising a connector. The chassis includes a dismounting and mounting opening communicating with the opening. The connector of the refrigerant pipe is exposed through the dismounting and mounting opening and the opening.

Optionally, the lower panel includes an avoiding hole corresponding to the dismounting and mounting opening, and a cover plate detachably connected with a periphery of the avoiding hole to close or open the avoiding hole and the dismounting and mounting opening. The connector of the refrigerant pipe is exposed from the dismounting and mounting opening and the avoiding hole.

Optionally, the periphery of the avoiding hole comprises a first locking structure and an inner sidewall of the cover plate comprises a second locking structure. The cover plate is detachably connected with the lower panel through the first locking structure and the second locking structure.

Optionally, the air conditioner indoor unit further includes an upper panel. A side of the upper panel is rotatably connected with an upper side of the face frame. The other side of the upper panel is snap-fitted with the lower panel.

Optionally, a front side of the face frame includes a mounting opening covered by the upper panel. Additionally or alternatively, an inner side surface of the upper panel comprises a first clamping member in a slot shape, an outer sidewall of the lower panel comprises a second clamping member in a hook shape, and the upper panel is connected with the lower panel through the first clamping member and the second clamping member.

Optionally, the indoor unit further includes an air guiding assembly. The air guiding assembly is detachably connected with the periphery of the air outlet. Alternatively, the air guiding assembly is mounted at the face frame and faces the air outlet.

The present disclosure further provides an air conditioner including an indoor unit. The indoor unit includes:

- a housing including a face frame and a chassis connected with a rear portion of the face frame. The lower portion of the face frame is configured with an opening;
- an air duct assembly mounted at the chassis and exposed from the opening; and
- a lower panel including an air outlet in communication with the air duct assembly, a periphery portion of the lower panel is detachably connected with an edge of the opening or the air duct assembly, and a periphery of the air outlet of the lower panel is connected with the air duct assembly by a screw.

According to the technical solution of the present disclosure, the opening is provided in the lower part of the housing of the indoor unit, and the duct assembly is exposed outside from the opening. The lower panel is detachably connected with the edge of the opening. The air duct assembly is exposed from the opening by disassembling the lower panel from the edge of the opening, so that a large space is provided to clean the air duct assembly. The disassembling operation is simple and convenient, and the installation and dismounting efficiency are improved, so it is convenient to clean the air duct assembly. Meanwhile, the periphery of the lower panel is detachably connected with the edge of the opening or the air duct assembly, and the periphery of the air outlet of the lower panel is connected with the air duct assembly by a screw. Thus the lower panel can be tightly connected with the face frame, for preventing the lower panel from deformation and wind leakage, and improving the installation stability. Therefore the air outlet effect of the indoor unit is improved.

BRIEF DESCRIPTION OF THE ACCOMPANYING DRAWINGS

In order to explain the embodiments of the present disclosure, the following will briefly introduce the drawings used in the description of the embodiments. Obviously, the drawings in the following description are only some embodiments of the present disclosure. For those ordinary skill in the art, other drawings can be obtained according to the structure shown in these drawings without any creative effort.

DESCRIPTION OF REFERENCE NUMERALS

TABLE 1

Figure 1:
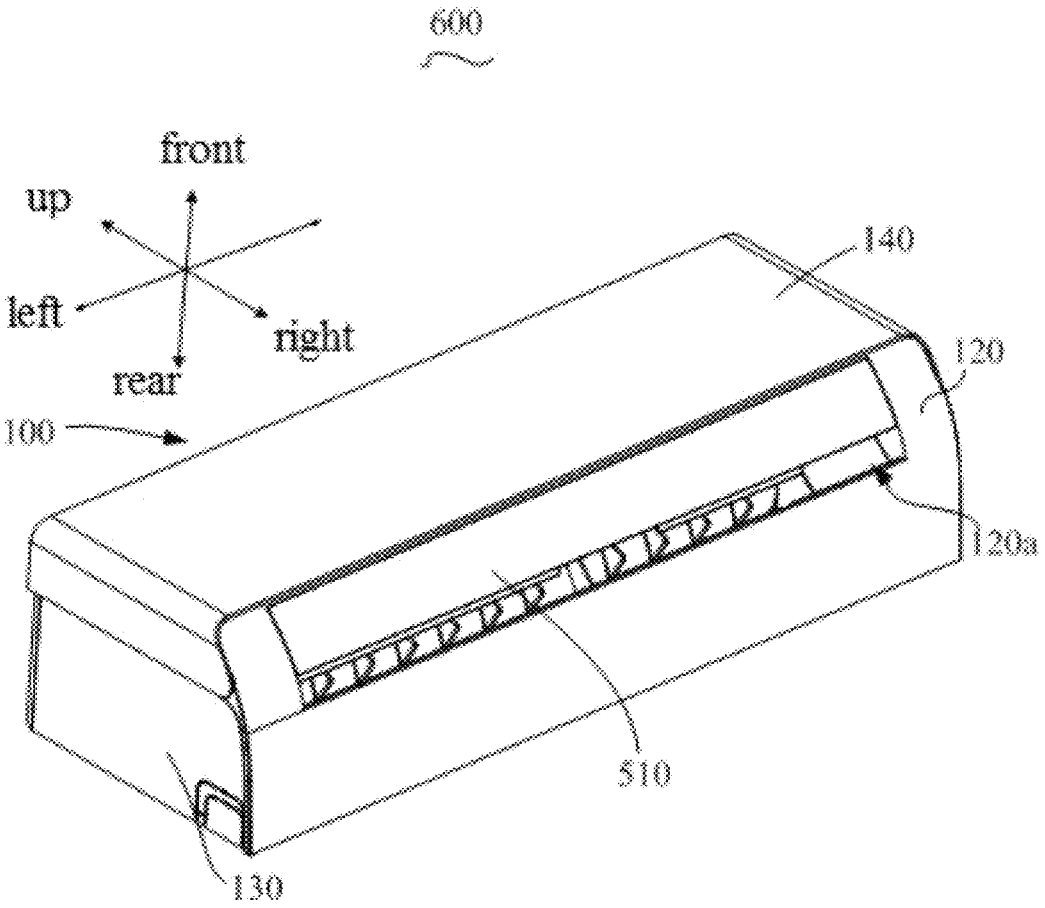
FIG. 1 is a schematic structural diagram of an air conditioner indoor unit according to an embodiment of the present disclosure.

| Reference Numeral | Name |
|---|---|
| 100 | Housing |
| 110 | Chassis |
| 111 | Bottom plate |

TABLE 1-continued

| Reference Numeral | Name |
|---|---|
| 113 | Dismounting and mounting opening |
| 120 | Lower panel |
| 120a | Air outlet |
| 121 | Insertion member |
| 122 | Clamping plate |
| 1221 | Snap hole |
| 123 | Clamping hole |
| 124 | Flange |
| 125 | First screw hole |
| 126 | Avoiding hole |
| 127 | Buckle |
| 128 | Second clamping member |
| 129 | First bolt hole |
| 130 | Face frame |
| 130a | Air inlet |
| 130b | Opening |
| 133 | Insertion hole |
| 134 | Fastener |
| 135 | Column |
| 1351 | Second bolt hole |
| 137 | Buckle hole |
| 140 | Upper panel |
| 141 | Edge cover |
| 142 | First clamping member |
| 150 | Cover plate |
| 200 | Heat exchanger |
| 210 | Front heat exchange member |
| 220 | Rear heat exchange member |
| 230 | Refrigerant pipe |
| 300 | Air duct assembly |
| 310 | Volute |
| 311 | Front water receiving tray |
| 3111 | Snap |
| 3113 | Support platform |
| 313 | Rear water receiving tray |
| 314 | Second screw hole |
| 320 | Air duct |
| 330 | Impeller |
| 400 | Electric control box |
| 500 | Air guiding assembly |
| 510 | Air guiding plate |
| 600 | Air conditioner indoor unit |

The implementation, functional characteristics, and advantages of the present disclosure will be further described with reference to the attached drawings in combination with embodiments.

DETAILED DESCRIPTION OF ILLUSTRATIVE EMBODIMENTS

In the following, the technical solution in the embodiments of the present disclosure will be described with reference to the drawings in the embodiments of the present disclosure. Obviously, the described embodiments are only some of the embodiments of the present disclosure, not all of the embodiments. Based on the embodiments described in the present disclosure, all other embodiments perceived by those ordinary skills in the art without creative effort should be fallen within the scope of the present disclosure.

It should be noted that all the directional indications in the embodiment of the present disclosure are only for explaining the relative positional relationship, the motion situation, or the like between the components in a certain attitude. If the specific attitude has been changed, the corresponding directional indication is also changed.

In the present disclosure, the terms "connected" and "fixed," etc., should be understood in a broad sense, unless otherwise specified and defined. For example, "fixed" can be a fixed connection or a detachable connection, or forming an integral part; can be a mechanical connection or an electrical connection; can be a direct connection or an indirect connection through an intermediate medium; and can be the communication between interior of two elements or the interaction between two elements, unless otherwise specifically defined. For those ordinary skilled in the art, the specific meanings of the aforementioned terms in the present disclosure can be understood according to practical conditions.

In addition, the descriptions of "first," "second," or the like in the present disclosure are only used for the purpose of description, and not to be construed as indicating or implying their relative importance or implicitly indicating the number of technical features indicated. Thus, a feature associated with "first" or "second" may explicitly or implicitly include at least one of the feature. In addition, the technical solutions of various embodiments may be combined with each other as long as they do not conflict with each other.

The present disclosure provides an air conditioner indoor unit 600.

In one embodiment of the present disclosure, referring to FIGS. 1 to 14, the indoor unit 600 includes a housing 100, an air duct assembly 300, and a lower panel 120. The housing 100 includes a face frame 130 and a chassis 110 connected with a rear portion of the face frame 130. The lower portion of the face frame 130 is configured with an opening 130*b*. The air duct assembly 300 is mounted at the chassis 110 and is exposed from the opening 130*b*. The lower panel 120 includes an air outlet 120*a* in communication with the air duct assembly 300. A periphery portion of the lower panel 120 is detachably connected with an edge of the opening 130*b* or the air duct assembly 300. The lower panel 120 is connected with the air duct assembly 300 by a screw at the air outlet.

In this embodiment, the indoor unit 600 includes a housing 100, which specifically includes a chassis 110 and a face frame 130. The face frame 130 and the chassis 110 enclose to form a mounting cavity. The heat exchanger 200 and the air duct assembly 300 are installed in the mounting cavity 300. The heat exchanger 200 is disposed above the air duct assembly 300. The surface of the chassis 110 away from the face frame 130 is detachably connected with a wall-mount panel (not shown). The indoor unit 600 is mounted at the wall surface by the wall-mount panel. The top wall surface of the face frame 130 of the present disclosure has an air inlet 130*a*. That is, air can enter the indoor unit 600 from the top. The indoor unit 600 has an air outlet 120*a* communicating with the mounting cavity. The outside air enters through the air inlet 130*a*, and passes through the heat exchanger 200, and then is blown out through the air outlet 120*a* under the driving of the air duct assembly 300. When the air conditioner indoor unit 100 is normally mounted at the wall, the up-down direction is the direction from the air inlet 130*a* to the air outlet 120*a*, the front-rear direction is the direction from the wall surface to the face frame 130, the left-right direction is the longitudinal direction of the air conditioner indoor unit 100.

An opening 130*b* is formed in a lower portion of the face frame 130. The opening 130*b* is corresponding to the air duct assembly 300. The air duct assembly 300 includes an impeller 330, a volute tongue, a volute 310, a water receiving tray disposed at the volute 310, and an air guiding assembly. Thus, when the lower panel 120 is opened, the air duct assembly 300 located at an inner side of the opening 130*b* can be exposed from the opening 130*b*. From the outside to the inside of the air duct assembly 300 are sequentially arranged the air guiding assembly, the volley tongue, the water receiving tray, the volute 310, and the impeller 330, in this order. In some embodiments, the volute 310 and the chassis 110 can be one integral structure. In some other embodiments, the volute 310 and the chassis 110 can be separate structures and assembled together. The heat exchanger 200 at least includes a front heat exchange member 210 and a rear heat exchange member 220 fitting with the front heat exchange member 210 to form a flare facing downward. The rear heat exchange member 220 is adjacent to the wall to which the indoor unit 600 is mounted. The volute tongue and the volute 310 cooperate with each other to form the air duct 320. The impeller 330 is located in the air duct 320. The inlet of the air duct 320 is connected with a flared portion formed by the heat exchanger 200. And the outlet of the air duct 320 is connected with the air outlet 120*a*. Under the driving of the impeller 330, the outside air enters into the housing 100 through the air inlet 130*a* in the air duct 320 and is blown out through the air outlet 120*a*.

The water receiving tray on the volute 310 is divided into a front water receiving tray 311 and a rear water receiving tray 313. The front water receiving tray 311 is configured to receive the condensed water generated during the heat exchange process of the front row heat exchange unit 210. The rear water receiving tray 313 is configured to receive the condensed water generated during the heat exchange process of the rear heat exchange member 220. At least one of the left and right ends of the water receiving tray includes a water outlet hose. The water outlet hose of the water receiving tray is connected with a drain pipe to drain the condensed water from the indoor unit 600. The water outlet hose is also exposed from the opening 130*b*, thereby improving the convenience for dismounting or repairing the drain pipe.

In addition, the indoor unit 600 further includes an electric control box 400 disposed at one end of the heat exchanger 200. For facilitating the wire connection of the indoor unit 600, the electric control box 400 is also exposed from the opening 130*b*. Further, the wire can be connected with other component conveniently when it needs to clean or connect the pipeline, thus the installation efficiency is further improved.

According to the technical solution of the present disclosure, an opening 130*b* is provided at a lower portion of the housing 100 of the indoor unit 600. The air duct assembly 300 is exposed from the opening 130*b*, and the lower panel 120 is detachably connected at the opening 130*b* or with an edge portion of the air duct assembly. The opening 130*b* is opened by removing the lower panel 120, so that the air duct assembly 300 is exposed from the opening 130*b*, and a large space is provided to clean the air duct assembly 300. The operation is simple and convenient, and the dismounting and installing efficiency is improved, and the convenience of cleaning is further improved. At the same time, a periphery portion of the lower panel 120 is detachably connected with an edge portion of the opening 130*b* or the air duct assembly 300, and is connected with the air duct assembly 300 by screw at the air outlet 120*a*. As such, a relatively tight closure is realized, the deformation of the lower panel 120 is avoided, the stability of the installation is improved, and the air leakage is prevented, thereby the air outlet effect of the indoor unit 600 is improved.

Figure 8:
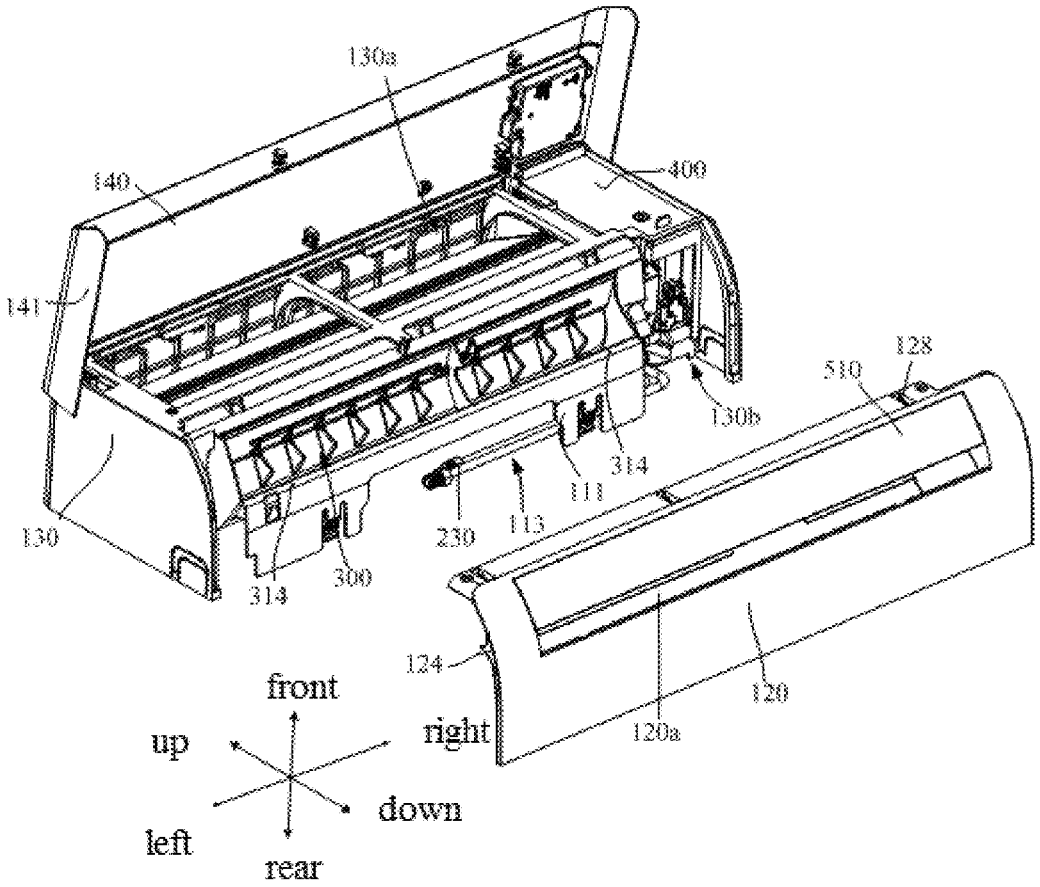
FIG. 8 is an exploded diagram of the indoor unit in FIG. 1.
Figure 9:
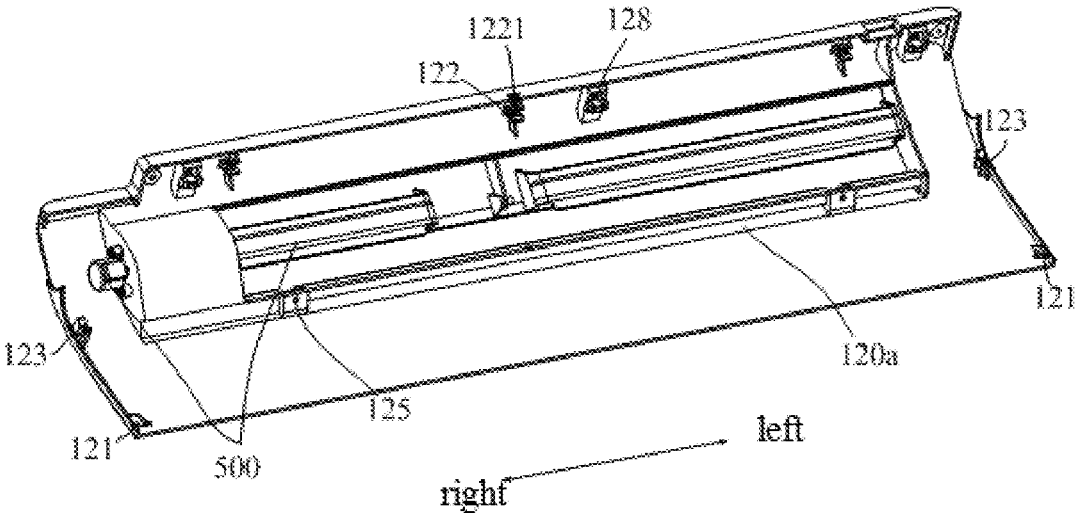
FIG. 9 is a schematic structural diagram of the lower panel of the indoor unit in FIG. 1, showing from another perspective.
Figure 10:
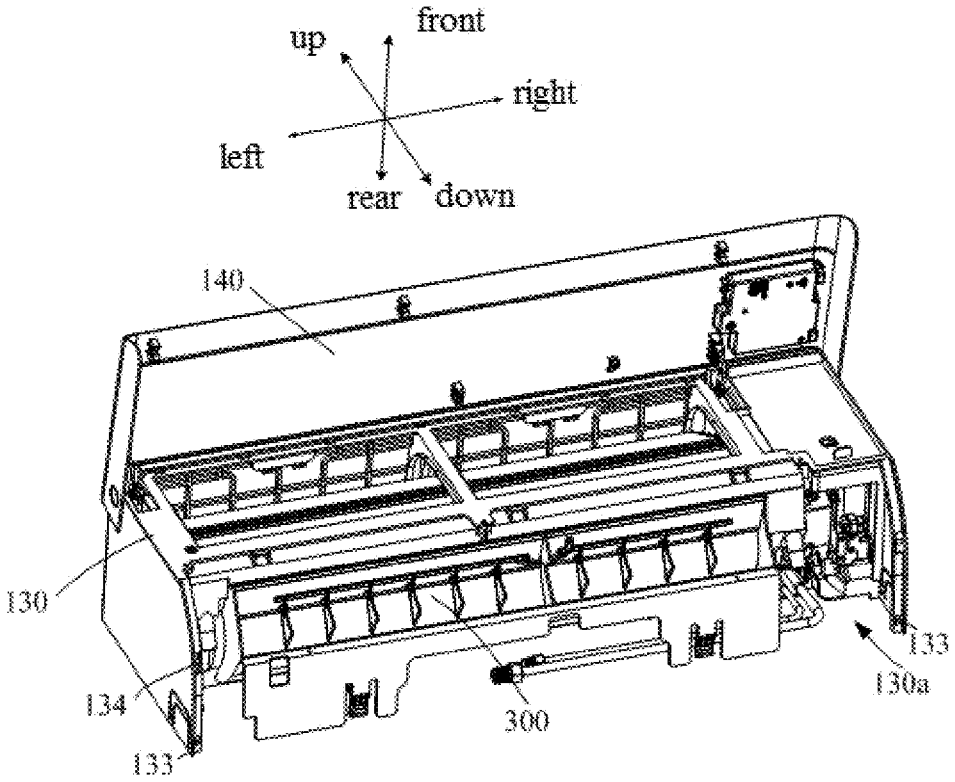
FIG. 10 is a schematic structural diagram of an indoor unit according to another embodiment of the present disclosure with a lower panel thereof removed.
Figure 11:
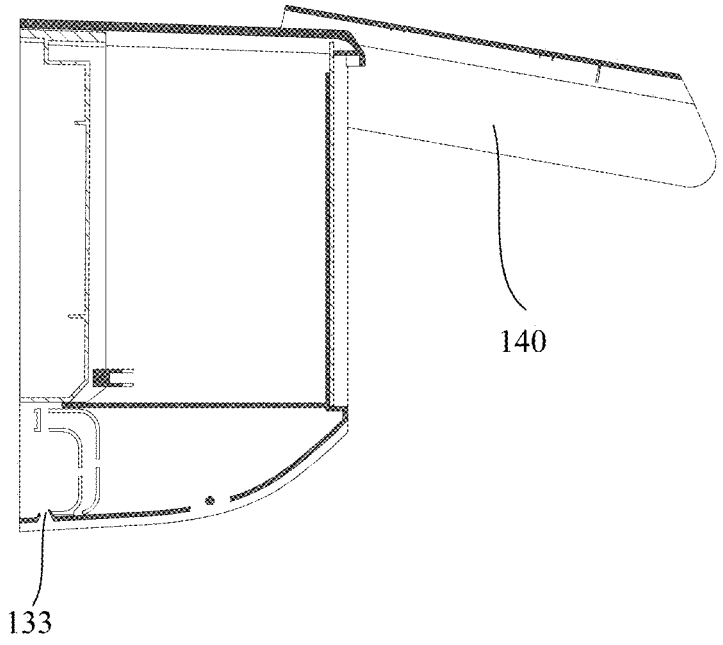
FIG. 11 is a cross-sectional diagram of the indoor unit in FIG. 10.
Figure 12:
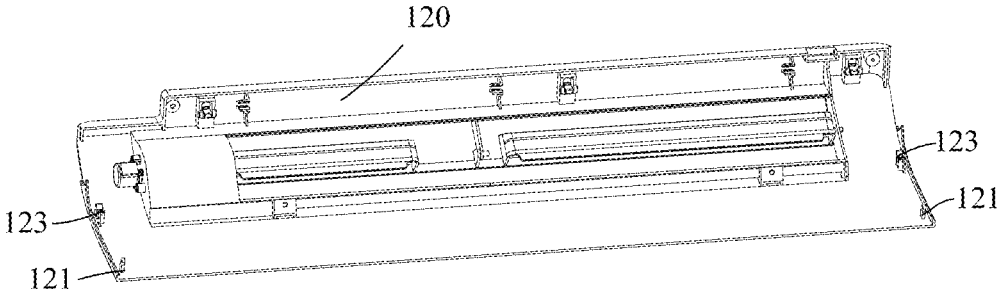
FIG. 12 is a schematic structural diagram of the lower panel of the indoor unit in FIG. 10.
Figure 13:
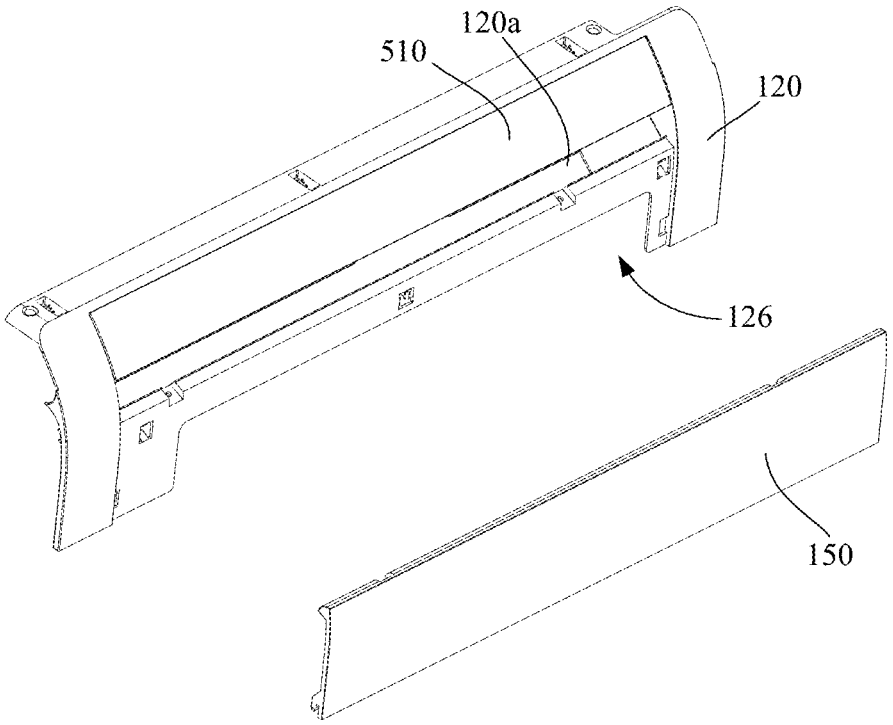
FIG. 13 is an exploded diagram of the lower panel of the indoor unit according to another embodiment of the present disclosure.

Referring to FIG. 8 and FIG. 10, an air guiding assembly 500 is detachably connected with the periphery portion of the air outlet 120*a*.

Alternatively, the air guiding assembly 500 is mounted at the face frame 130 and faces to the air outlet 120*a*.

In this embodiment, the air guiding assembly 500 includes a louver assembly and an air guiding plate 510. The wind is guided along the left-right direction by the louver assembly. The air guiding plate 510 is rotatably connected with the surface frame 130 or the lower panel 120, thereby the wind direction of the air outlet 120*a* is guided in the up-down direction. The air blowing effect is enhanced by the cooperation of both the louver assembly and the air guiding plate 510. In this embodiment, the louver assembly is mounted at the chassis 110. The air guiding plate 510 is detachably connected with a periphery portion of the air outlet 120*a*. A driving motor is connected with one side of the air guiding plate 510. When the lower panel 120 is rotated and opened, the air guiding plate 510 and the drive motor can be repaired or cleaned. And the louver structure can be conveniently simultaneously cleaned or repaired. Thereby the convenience of cleaning is further improved.

Figure 14:
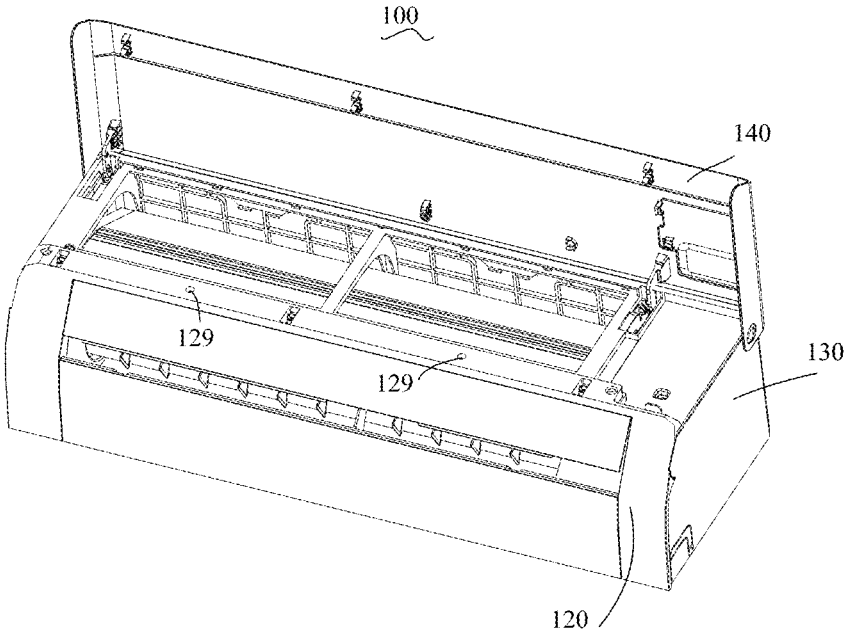
FIG. 14 is a schematic structural diagram of an indoor unit according to another embodiment of the present disclosure with an upper panel thereof in the open state.
Figure 15:
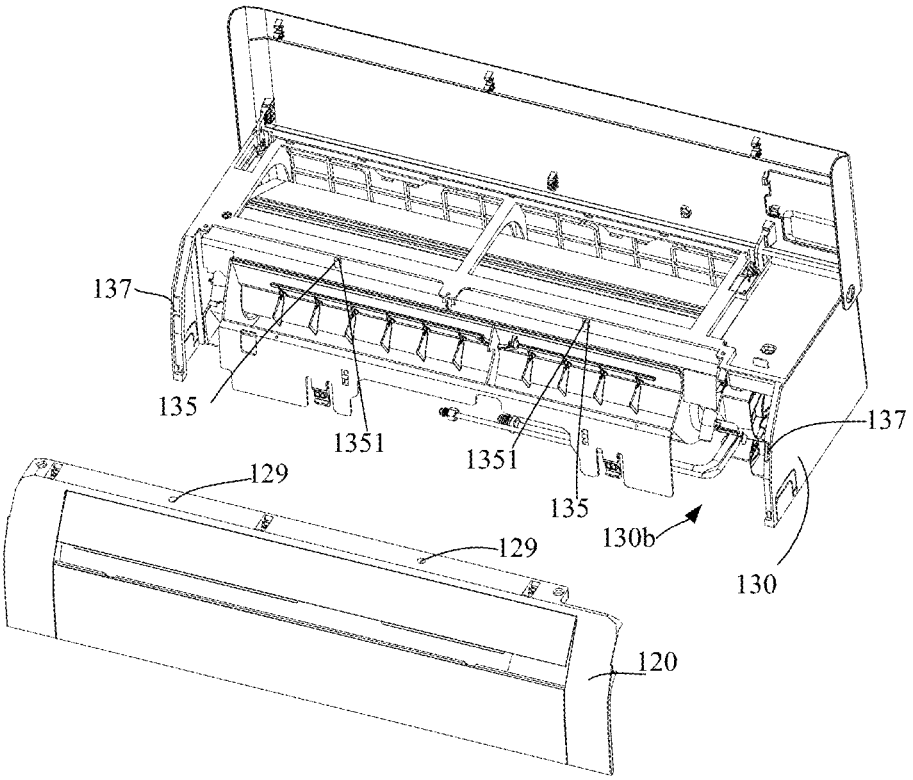
FIG. 15 is an exploded diagram of the indoor unit in FIG. 14.
Figure 16:
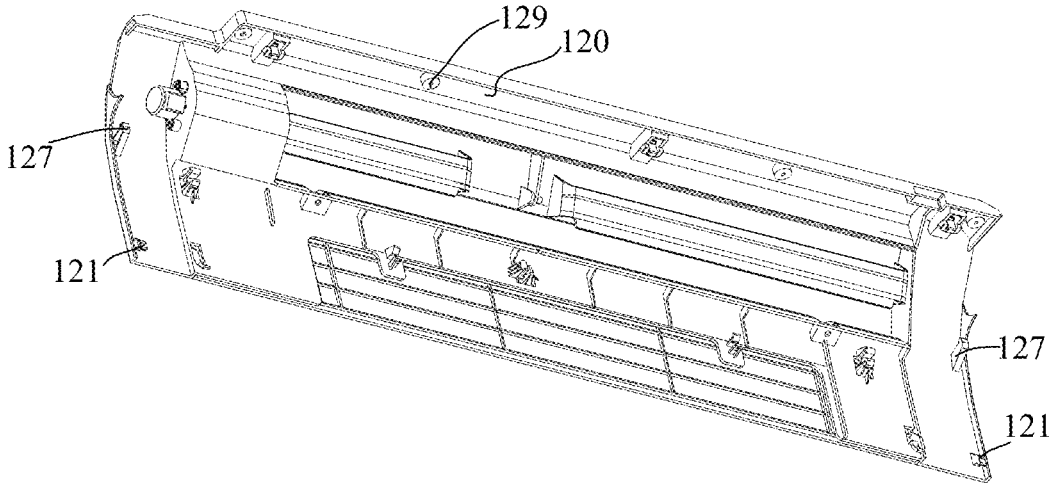
FIG. 16 is a schematic structural diagram of a lower panel of the indoor unit in FIG. 14.
Figure 17:
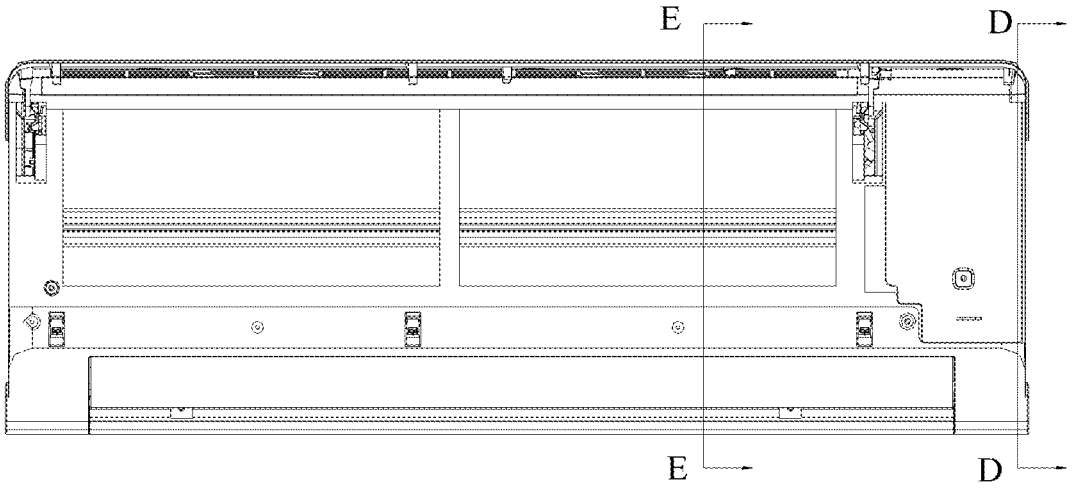
FIG. 17 is a front diagram of the indoor unit in FIG. 14.
Figure 18:
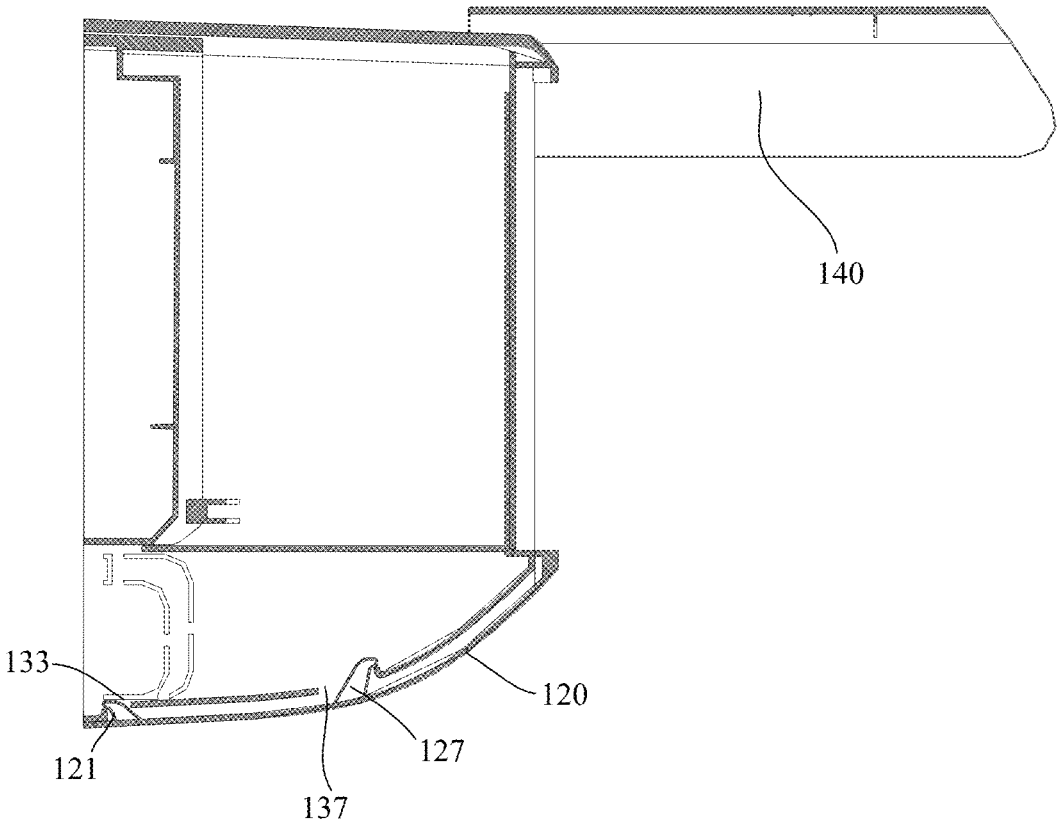
FIG. 18 is a cross-sectional diagram taken along the D-D line in FIG. 17.
Figure 19:
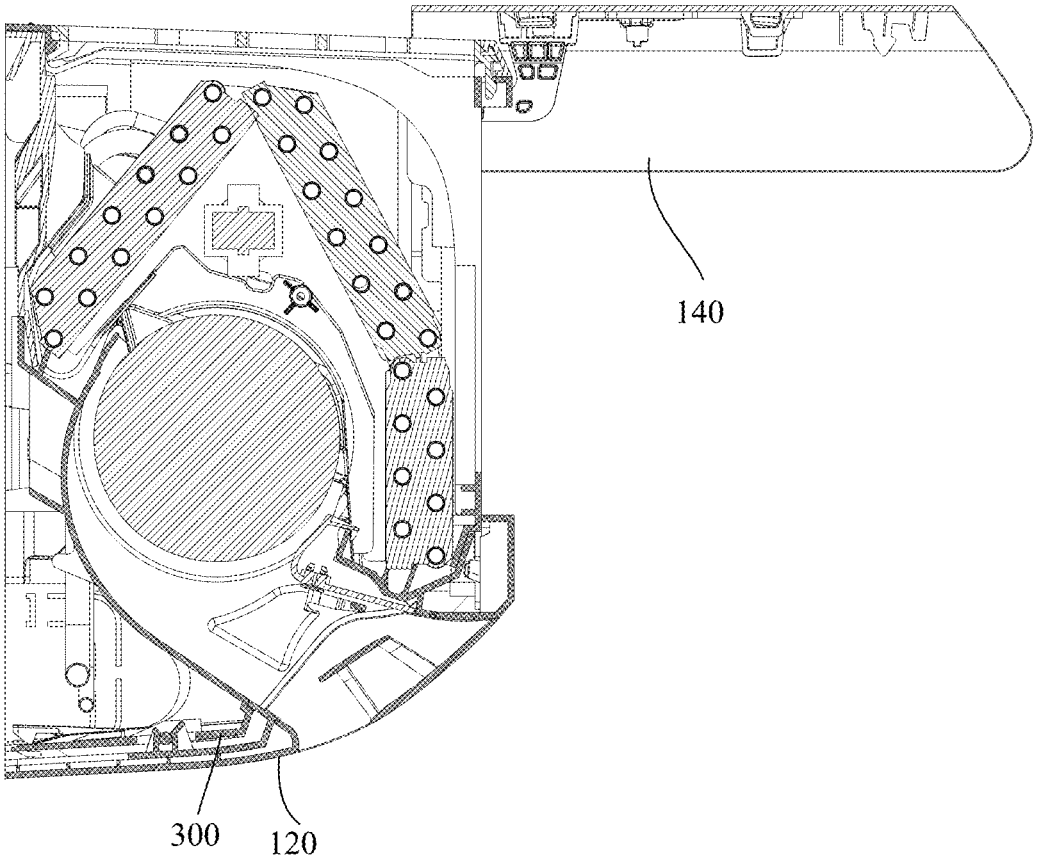
FIG. 19 is a cross-sectional diagram taken along the E-E line in FIG. 17.

Referring to FIG. 8 and FIG. 14, the heat exchanger 200 is connected with a refrigerant pipe 230. The chassis 110 is configured with a dismounting and mounting opening 113. The lower panel 120 includes an avoiding hole 126 corresponding to the dismounting and mounting opening 113. The connector of the refrigerant pipe 230 is exposed from the dismounting and mounting opening 113 and the avoiding hole 126; and the cover plate 150 is detachably connected with a periphery of the avoiding hole 126 to close or open the avoiding hole 126 and the dismounting and mounting opening 113.

A refrigerant flow path is formed between the indoor unit 600 and the outdoor unit by the refrigerant pipe 230 connected with the heat exchanger 200. Since operation such as pipe cleaning is needed in the process of installing the indoor unit 600 or conducting routine maintenance. For example, the indoor unit 600 is needed to connect with the air conditioner outdoor unit to configure a refrigerant pipe circulation circuit. According to the present disclosure, a bottom plate 111 is provided at the bottom of the chassis 110. The dismounting and mounting opening 113 is configured at the bottom plate 111 and is in communication with the mounting cavity. Correspondingly, the lower panel 120 is configured with an avoiding hole 126. A refrigerant pipe connector of the refrigerant pipe 230 and the drain pipe can both be exposed through the dismounting and mounting opening 113 and the avoiding hole 126. A periphery portion of the avoiding hole 126 is further connected with a cover plate 150 to open or close the avoiding hole 126, and to further open or close the dismounting and mounting opening 113. The dismounting and mounting opening 113 extends in the left-right direction of the indoor unit 600 and has a long strip shape. The dismounting and mounting opening 113 can expose at least the connectors of the refrigerant pipe 230 and the drain pipe. The width of the dismounting and mounting opening 113 in the front-rear direction of the indoor unit 600 is suitable for a human hand or a tool to enter, so that the refrigerant pipe 230 and the drain pipe can be directly dismounted and installed.

Specifically, an outer periphery of the escaping hole 126 is configured with a first locking structure. Correspondingly, the inner sidewall surface of the cover plate 150 is configured with a second locking structure, and the cover plate 150 is detachably connected with the lower panel 120 through a cooperation of the first locking structure and the second locking structure. The connection between the first locking structure and the second locking structure can be a clamping connection, an insertion connection, a rotation connection, a magnetic connection, etc., and is not limited here.

Since the chassis 110 includes the dismounting and mounting opening 113, which communicates with the opening 130*b*, the connector of the refrigerant pipe 230 is exposed through the opening 130*b*. Therefore, the lower panel 120 may not have the avoiding hole 126, and the purpose of dismounting and mounting pipelines can be achieved by dismounting and mounting the lower panel 120.

Figure 3:
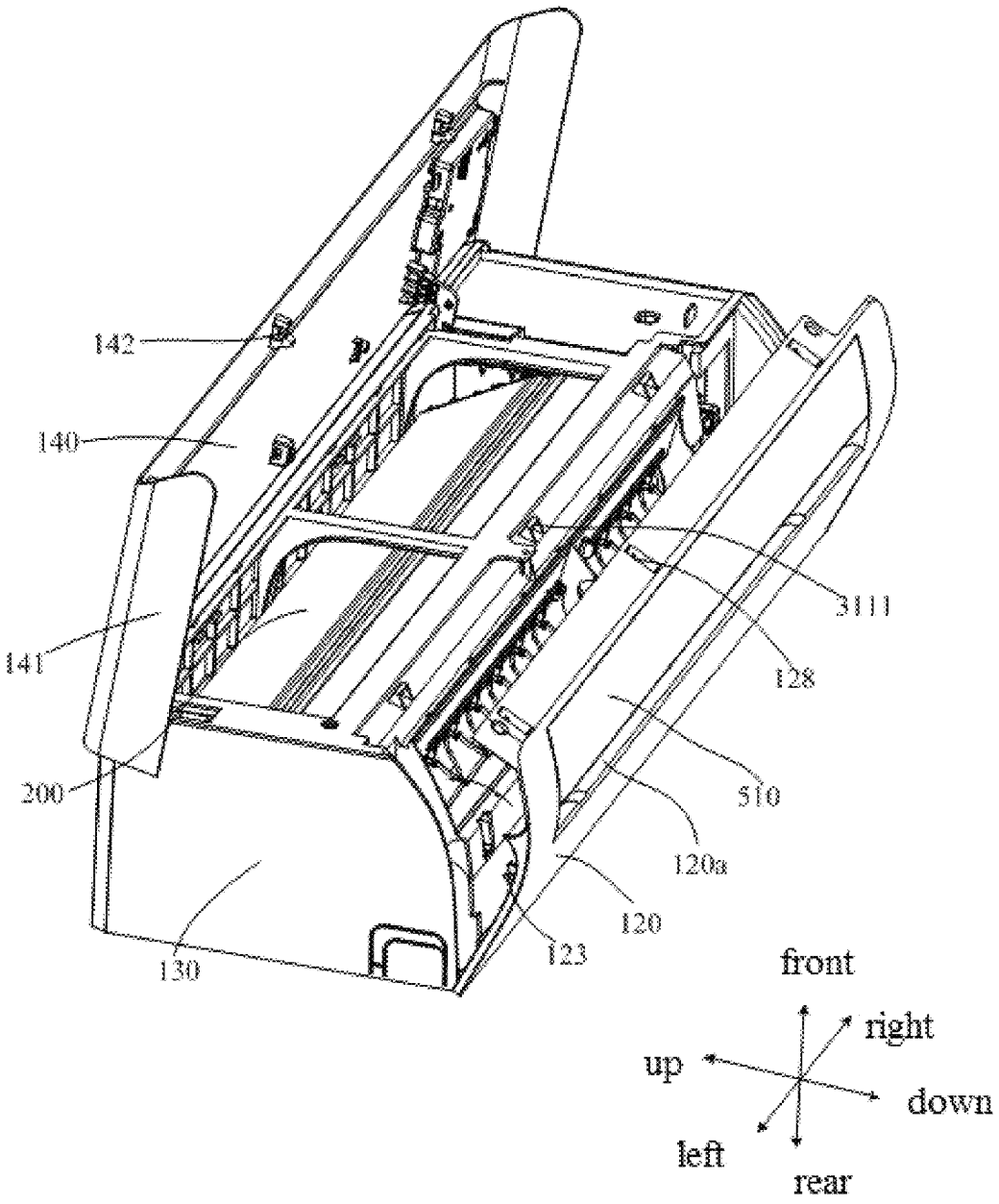
FIG. 3 is a schematic structural diagram of the indoor unit in FIG. 1 with the upper panel and a lower panel thereof in an open state.
Figure 4:
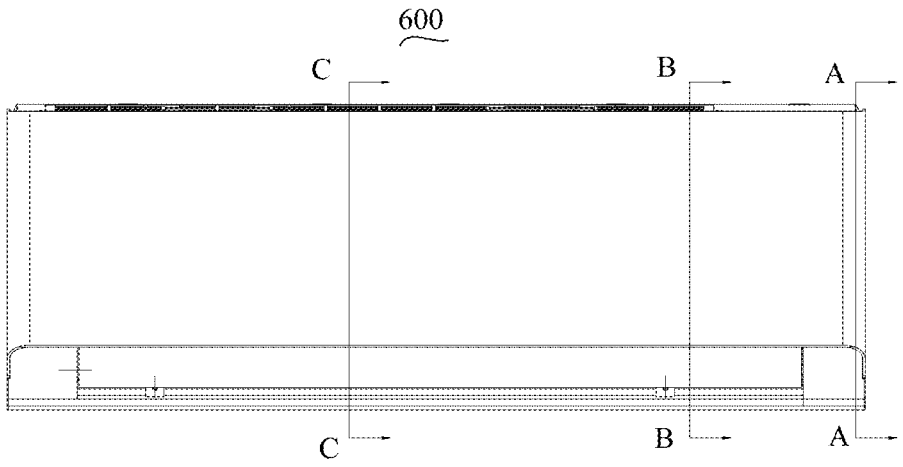
FIG. 4 is a front structural diagram of the indoor unit in FIG. 1.
Figure 5:
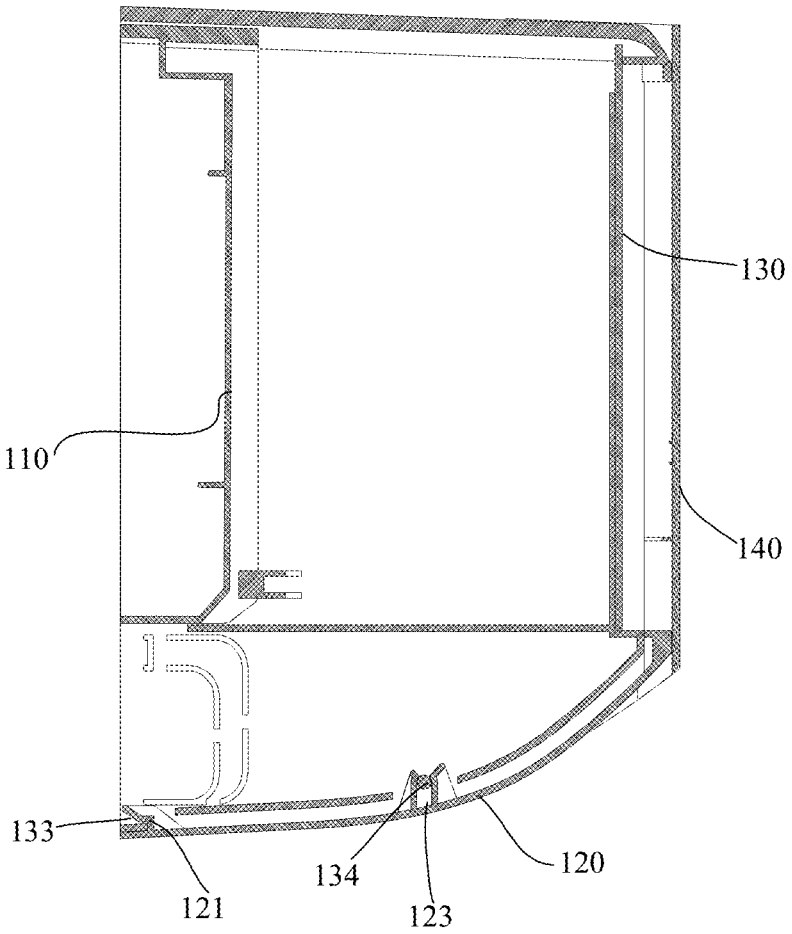
FIG. 5 is a cross-sectional diagram taken along the A-A line in FIG. 4.
Figure 6:
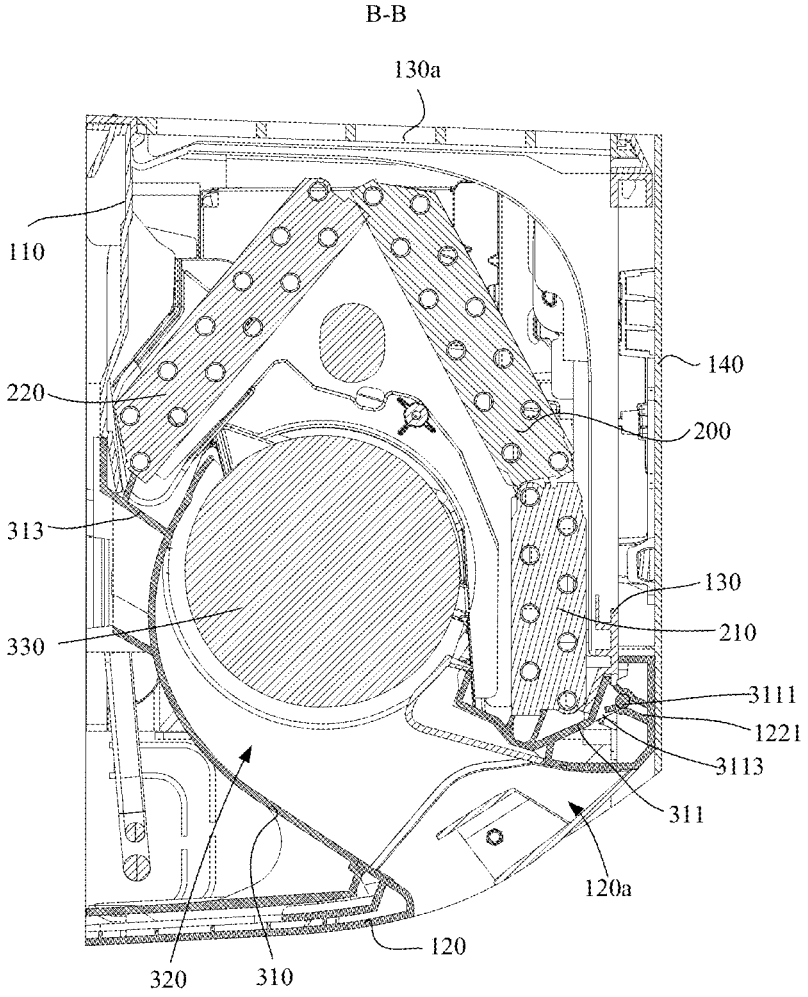
FIG. 6 is a cross-sectional diagram taken along the B-B line in FIG. 4.

Referring to FIG. 3, optionally, a periphery portion of the air outlet 120*a* of the lower panel 120 includes a plurality of first screw holes 125, and the air duct assembly 300 includes a plurality of second screw holes 314. A locking member passes through the first screw hole 125 and the second screw hole 314 to connect the lower panel 120 and the air duct assembly 300.

In this embodiment, in order to increase the stability of the connection between the lower panel 120 and the face frame 130, a lower periphery portion of the air outlet 120*a* includes at least one first screw hole 125. The corresponding second screw hole 314 is provided at the bottom plate 111 of the air duct assembly 300. Because the air outlet 120*a* is located at a middle position in the left-right direction of the lower panel 120, the locking member through the first screw hole 125 and the second screw hole 314 is used to enhance the connection between the lower panel 120 and the middle portion of the face frame 130. Thus, the stability of the connection is improved, and a large gap in the middle portion of the connection portion which between the upper end and the lower end of the lower panel 120 is avoided due to the connection. The air volume and the air outlet effect are affected, and the deformation of the lower panel 120 is prevented.

Based on the above structure, in one embodiment of the present disclosure, referring to FIG. 3 to FIG. 8 and FIG. 11 to FIG. 13, connections between side portions of the lower panel 120 in the front-rear direction and side edge portions of the opening 130*b* or side edge portions of the air duct assembly 300 can be one or more of a buckle connection, a sliding connection, and a plug connection.

In this embodiment, the two sides of the lower panel 120 are connected by manners of a buckle, a slider, or a plug. The buckle connection includes a hook-connection between a hook and a hole, or a clamp-connection between a snap and a hole. The sliding connection includes a clamp-connection between a hook and a hole, or between a snap and a hole. When the hook or the snap is being dismounted or installed, a sliding tendency exists. The plug connection includes the cooperation between an insertion plate or an insertion bar and a hole, to be directly buckled by interference fit. The mode of connection is simple and quick, which makes the dismounting and installing of the lower panel 120 more convenient. After the screw connection is removed, a force can be applied to the lower panel 120 to pull it outward to dismount the lower panel 120, thereby the opening 130*b* is exposed. Furthermore, the two sides of the lower panel 120 are each connected by a buckle or a plug, so that the situation that the convex warp and untight sealing on one side is avoided, thus the installation of the lower panel 120 is more stable. In addition, the removable connection between the two sides of the lower panel 120 and the face frame 130 or the air duct assembly 300 may also be a sliding connection, a magnetic connection, or a screw connection, or the like, which is not limited here.

In a specific embodiment, the lower panel 120 includes a snap hole 1221 at an inner wall surface of a front side of the lower panel 120. The face frame 130 or the air duct assembly 300 comprises a snap 3111 corresponding to the snap hole 1221, and the snap 3111 is fitted in the snap hole 1221 when the opening 130*b* is closed by the lower panel 120.

In this embodiment, the front side of the lower panel 120 is buckle-fastened on the face frame 130 or the air duct assembly 300 by the cooperation between the snap 3111 and the snap hole 1221. The lower panel 120 is buckled by pressing the other side of the lower panel 120, which is simple and convenient, and the dismounting and installing convenience is improved. In some other embodiments, other buckle-manners can be used as the connections between the lower panel 120 and the face frame 130 or the air duct assembly 300, such as the cooperation between a locking head and a buckle component. The time and effort are further saved.

Specifically, the inner wall surface of the front side of the lower panel 120 is protruded with two clamping plates 122 arranged at interval, and the two clamping plates 122 are enclosed to define the snap hole 1221. And the face frame 130 or the air duct assembly 300 is protruded with two support platforms 3113 arranged at interval, and the snap 3111 is connected with top ends of the two support platforms 3113. One of the clamping plate 122 is inserted between two support platforms 3113, and the snap 3111 is pressed by the other clamping plate 122, so that the snap 3111 is buckled in the snap hole 1221.

In this embodiment, in order to improve the fastening stability of the snap 3111 and the snap hole 1221, the clamping plate 122 is protruding from the lower panel 120. Each of the two clamping plates 122 is in a plate shape. The two clamping plates 122 are parallel to each other, and a first surface of one clamping plate 122 and a second surface of the other clamping plate facing the first surface each include a groove, and the two clamping plate 122 enclose to form the round snap hole 1221. Further, the lower panel 120 is connected with the front water receiving tray 311 of the air duct assembly 300. A support platform 3111 is connected to the front water receiving tray 311. The two support platforms 3111 are each in a plate shape. The two support platforms 3111 are parallel to each other and the parallel direction thereof is perpendicular to the parallel direction of the two clamping plates 122, such that the two ends of the clamping plate 122 can be clamped between the two support platforms 3113, and the lower panel 120 can be limited in the left-right direction. As such, the stability of the installation of the lower panel 120 is further improved. Further, the interference between the lower panel 120 and the front water receiving tray 311 is prevented by the arrangements of the clamping plate 122 and the support platform 3113, and a better cover tightness exists.

Referring to FIG. 5, FIG. 8, FIG. 11, and FIG. 13, a rear side of the lower panel 120 is provided with an insertion member 121. The edge of the opening 130*b* adjacent to a rear side of the chassis 110 includes an insertion hole 133. The insertion member 121 is fitted in the insertion hole 133 when the opening 130*b* is closed by the lower panel 120.

In this embodiment, the rear side of the lower panel 120 is fitted in the face frame 130, so that the lower panel 120 can be conveniently fixed. The front side of the lower panel 120 is pressed to be buckle-connected. This connection mode is more consistent with a user's installation habit. The end near to the user is convenient to be pressed, and the dismounting efficiency of the lower panel 120 is further improved, thereby the convenience of cleaning is improved.

Specifically, the opening of the insertion hole 133 faces the directions of the front side and the lower side. The insertion of the insertion member 121 is facilitated. The insertion hole 133 extends in the front-rear direction. The insertion member 121 has a long strip shape, which allows it to be more conveniently inserted into the insertion hole 133. The insertion member 121 protrudes from the inner wall surface of the lower panel 120, and is inclined toward the rear side and the end portion thereof is bent toward the rear side in a ladder shape. As such, when the insertion member 121 is being inserted, a space that opens an angle is retained between the lower panel 120 and the face frame 130 to facilitate the fastening of the other side of the lower panel 120. The convenience of dismounting and installing is further improved by the structure thereof, thereby the convenience of cleaning is improved. The insertion member 121 inserted in the insertion hole 133 can restrict the displacement of the lower panel 120 in the up-down direction. In addition, the insertion member 121 may also be a structure of another embodiment of the present disclosure. The opening of the insertion hole 133 faces downward and extends in the front-rear direction. The insertion member 121 protrudes from the surface of the lower panel 120, and extends toward the rear side, corresponding to the insertion hole 133. The end of the insertion hole 133 is in a hook shape. When the insertion member 121 is inserted in the insertion hole 133, the end of the insertion hole 133 can hook the periphery of the insertion hole 133. The structure thereof is relatively simple and easy to dismount and install. In some other embodiments, the front side of the lower panel 120 is plugged, and the rear side of which is buckled.

Referring to FIG. 14 to FIG. 19, in another embodiment of the present disclosure. A side of the lower panel 120 in the front-rear direction is connected with the side edge of the opening 130*b* or the side edge of the air duct assembly 300 by a screw. Another side of the lower panel 120 in the front-rear direction is connected with another side edge of the opening 130*b* or another side edge of the air duct assembly 300 by slot-plug fit.

In this embodiment, one side of the lower panel 120 in the front-rear direction is connected by screw, and the other side is connected by plug. Thus the installation and dismounting efficiency is guaranteed and the installation stability of the lower panel 120 is ensured and the deformation is avoided. Thereby, the use time of the connection structure of the lower panel 120 is extended.

Specifically, an inner wall surface of a front side of the lower panel 120 includes a first bolt hole 129. The face frame 130 includes a column 135 protruding from the face frame 130, and the column 135 includes a second bolt hole 1351. A locking member can penetrate through the first bolt hole 129 and the second bolt hole 1351.

In this embodiment, by using the column 135, a long screw can be used to connect the column 135 to enhance the stability of the screw connection. The first bolt hole and the second bolt hole can both be through holes or screw holes. There can be a plurality of columns 135, which are evenly arranged along the longitudinal direction of the indoor unit 600. Accordingly, a plurality of first bolt holes 129 are also provided, thereby the installation stability of the lower panel 120 is further improved.

For the insertion structure of the rear side of the lower panel 120, the insertion member 121 and the insertion hole 133 in the above embodiment can be used. The opening of the insertion hole 133 faces downward and extends in the front-rear direction. The insertion member 121 is protruding from the surface of the lower panel 120, and extends backwards corresponding to the insertion hole 133, the end thereof is in a hook shape. When the insertion member 121 is inserted in the insertion hole 133, the end portion of the insertion hole 133 can hook the edge portion of the insertion hole 133. The structure thereof is simple and convenient to be dismounted and installed, and the connection structure is stable. In some other embodiments, the plug structure may also be one of those other than the structure in the above embodiments.

In some embodiments, a clamping hole 123 or a buckle 127 is provided at one of a middle portion of the lower panel 120 in the front-rear direction and a middle portion of the edge of the opening 130*b* in the front-rear direction. Correspondingly, a fastener 134 matching the clamping hole 123 or a buckle hole 137 matching the buckle 127 is provided at another one of the middle portion of the lower panel 120 in the front-rear direction and the middle portion of the edge of the opening 130*b* in the front-rear direction.

In this embodiment, since both side portions of the lower panel 120 in the front-rear direction are connected with the face frame 130, and in order to enhance the connection of the middle portion in the front-rear direction, a buckle connection between the clamping hole 123 and the fastener 134 is provided. Thereby the connection stability of the lower panel 120 is further improved, and the airflow of the air duct 320 component is prevented from being affected by the gap. In some other embodiments, a structure with cooperation between the buckle 127 and the buckle hole 137, such as a cycle locking buckle, or the like, can be used.

Specifically, the middle portion of the lower panel 120 in the front-rear direction is protruded with two vertical plates facing with each other. A first surface of one vertical plate is faced with a second surface of the other vertical plate to form the clamping hole 123. The middle portion of the edge of the opening 130*b* in the front-rear direction includes a clamping groove. The bar shaped fastener 134 is connected with a sidewall of the clamping groove and fitted in the clamping hole 123. The vertical plates are inserted in the clamping groove, and the fastener 134 is inserted in the clamping hole 123. The buckling of the structure thereof can be achieved by merely applying a slight pressing. The cylindrically shaped fastener 134 and the matching circular clamping hole 123 also facilitate more labor-saving and efficiency in dismounting the lower panel 120.

Alternatively, a buckle 127 is arranged at a middle portion between the two ends of the lower panel 120 in the front-rear direction. Correspondingly, the face frame 130 includes a buckle hole 137 at a periphery of the opening 130*b*. The buckle 127 protrudes from the inner surface of the lower panel 120. The buckle 127 is configured to incline to the front side and the end portion thereof is bent forward. The buckle hole 137 extends in the front-rear direction, the lower panel 120 covers the opening 130*b*, the buckle 127 is inserted in the buckle hole 137, and the end portion thereof is hooked on the front side edge portion of the buckle hole 137.

In this embodiment, the buckle 127 is configured to incline to the front side and the end portion thereof is bent forward. The buckle 127 is inserted in the buckle hole 137, and the end portion thereof is hooked on the front side edge portion of the buckle hole 137. As such, the free end in the up-down direction of the lower panel 120 is restricted. Further, the buckle 127 and the insertion member 121 are inclined toward opposite directions. The buckle 127 and the insertion member 121 can exert a force against each other, when the lower panel 120 is buckled to the face frame 130. Thus the movement of the lower panel 120 in the front-rear direction is limited. As such, the structural stability of the lower panel 120 is further improved. And the connection stability of the middle portion of the lower panel 120 in the left-right direction is increased.

In addition, on the basis of any one of the above embodiments, in order to further increase the structural stability, a plurality of buckling structures are configured at the inner side surface of the lower panel 120. Each of the buckling structures can be any one or combination of the structures according to the above embodiments, so that the stability of the connection structure at each part of the lower panels 120 is guaranteed. Further, the deformation of the lower panel 120 is prevented, and the stability of the indoor unit 600 is improved.

Figure 2:
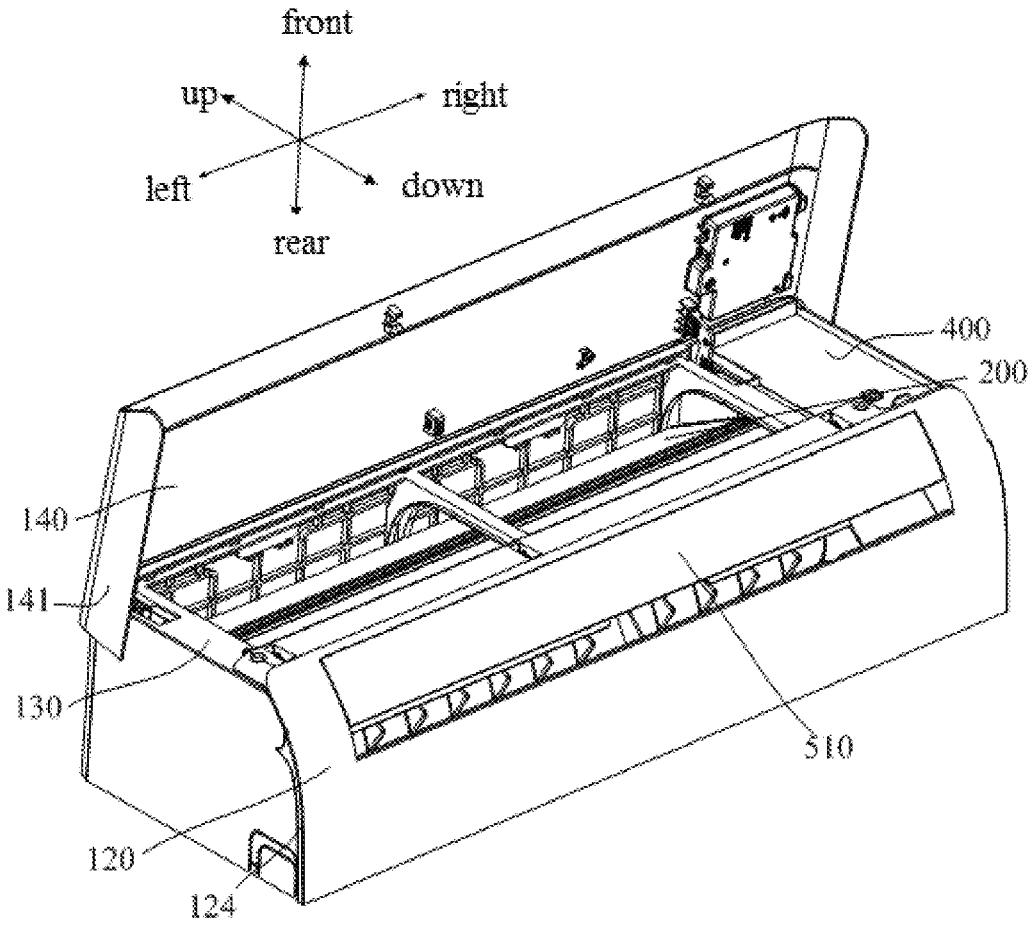
FIG. 2 is a schematic structural diagram of the indoor unit in FIG. 1 with an upper panel thereof in an open state.
Figure 7:
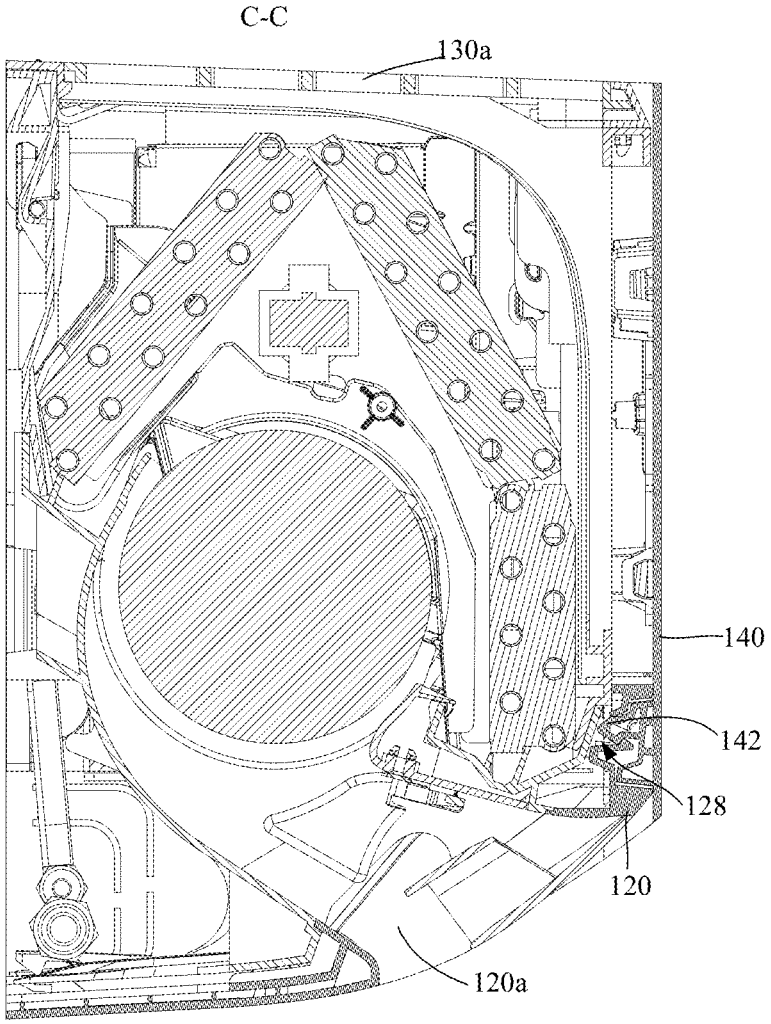
FIG. 7 is a cross-sectional diagram taken along the C-C line in FIG. 4.

Referring to FIG. 2, FIG. 3 and FIG. 7, the indoor unit 600 further includes an upper panel 140. A side of the upper panel 140 is rotatably connected with the upper side of the face frame 130. The other side of the upper panel 140 is buckle-connected with the lower panel 120.

In this embodiment, the front side of the face frame 130 includes a mounting opening, and the mounting opening is covered by the upper panel 140 for the protection and decorative effects. In some other embodiments, the indoor unit 600 can include a filter assembly, which can be dismounted and installed through the mounting opening. In order to facilitate the dismounting and installing, the connection mode between the upper panel 140 and the face frame 130 can include a rotational connection, so that the upper panel 140 and the face frame 130 can be opened from the rearward to forward direction. When the upper panel 140 is covered by the mounting opening, the other side of the upper panel 140 is buckled with the lower panel 120, and the specific connection type can be clamping, locking buckle, or magnetic connection, etc. In the embodiment, the inner sidewall surface of the upper panel 140 includes a first clamping member 142 in slot shape. The outer sidewall surface of the lower panel 120 includes a second clamping member 128 in hook shape. As such, the upper panel 140 can be lightly pressed to realize the locking between the two of the lower and upper panels. The operation thereof is simple and convenient. In some other embodiments, the upper panel 140 can also be buckle-connected with the face frame 130 and disposed by only splicing together the edge portion of the lower panel 120.

Referring to FIG. 1 and FIG. 2, two ends of the upper panel 140 each include an edge cover 141 covering the outer side surface of the face frame 130, and flanges 124 protrude from both ends of the lower panel 120 in the direction toward the face frame 130. An outer wall surface of the flange 124 is coplanar with an outer wall surface of the corresponding edge cover 141, when the lower panel 120 covers the opening 130*b*.

Alternatively, the two ends faces of the lower panel 120 are coplanar with the outer wall surfaces of the face frame 130, respectively.

In this embodiment, the lower panel 120 can cover the opening 130*b* of the entire face frame 130. The opening 130*b* includes the entire lower side space and the partial front side space of the face frame 130. As such, the rear side of the lower panel 120 directly abuts the outer wall surface of the chassis 110. Thereby the function of completely covering the opening 130*b* is achieved. In some embodiments, the rear side of the lower panel 120 can also be coplanar with the outer wall surface of the chassis 110 to directly abut the wall surface or the wall-mount panel. The two end surfaces of the lower panel 120 in the left-right direction may be coplanar with the outer wall surface of the face frame 130 or may be wrapped on the outer wall surface of the face frame 130. Specifically, the two end surfaces of the lower panel 120 in the left-right direction both has a flange 124. The flanges 124 are formed by bending the two ends of the lower panel 120 towards the face frame 130 respectively. The inner wall surface of the flange 124 abuts the outer wall surface of the face frame 130 to form a covering structure. Thus, on the one hand, the sealing property of the cover is increased. On the other hand, the stability of the rotation is realized according to the flange 124. The deviation causing the rotation to be unsmooth in the left-right direction is avoided. Correspondingly, the ends of the upper panel 140 each include an edge cover 141. The edge covers 141 thereof also provide a guiding rotation effect and can be tightly sealed. When the upper panel 140 covers the mounting opening, the outer wall surface of the edge cover 141 is coplanar with the outer wall surface of the corresponding flange 124. Thereby the appearance is more beautiful, and the tightness of the anastomotic connection is further provided.

The present disclosure also provides an air conditioner, including an indoor unit 600 and an outdoor unit connected with the indoor unit 600. For the specific structure of the indoor unit 600, reference can be made to the above embodiment. Since all technical solutions of the all above implementations are employed in the air conditioner, the air conditioner have at least all the effects brought by the all technical solutions of the above embodiments, and will not be further described here.

The foregoing description merely depicts some embodiments of the present disclosure and is not intended to limit the scope of the disclosure. An equivalent structural or flow change made by using the content of the specification and drawings of the present application, or any direct or indirect applications of the disclosure in any other related fields shall all fall in the scope of the disclosure.

What is claimed is:

1. An air conditioner indoor unit, comprising:

a housing including a face frame and a dismounting and mounting opening, an opening being formed at a lower portion of the face frame, and the dismounting and mounting opening being communicating with the opening;

an air duct assembly mounted in the housing;

a refrigerant pipe including a connector; and a lower panel including an air outlet in communication with the air duct assembly, an avoiding hole corresponding to the dismounting and mounting opening, and a cover plate detachably connected to a periphery of the avoiding hole and configured to close or open the avoiding hole and the dismounting and mounting opening;

wherein:

a periphery of the lower panel is detachably connected with an edge of the opening or the air duct assembly;

the opening is configured to expose the air duct assembly when the lower panel is opened; and the connector of the refrigerant pipe is configured to be exposed from the dismounting and mounting opening and the avoiding hole.

2. The indoor unit according to claim 1, wherein a connection between the periphery of the lower panel and the edge of the opening or an edge of the air duct assembly includes at least one of a snap-fit connection, a slider-slot fit connection, or a slot-plug fit connection.

3. The indoor unit according to claim 2, wherein:

the lower panel includes an insertion member at a side of the lower panel;

the edge of the opening includes an insertion hole at a side of the opening corresponding to the side of the lower panel; and the insertion member is configured to be fitted in the insertion hole when the lower panel closes the opening.

4. The indoor unit according to claim 3, wherein:

the side of the lower panel is a first side of the lower panel;

the lower panel further includes a buckle hole at an inner wall surface of a second side of the lower panel opposite to the first side;

the face frame or the air duct assembly includes a buckle corresponding to the buckle hole; and the buckle is configured to be fitted in the buckle hole when the lower panel closes the opening.

5. The indoor unit according to claim 4, wherein:

the lower panel further includes two clamping plates protruding from the inner wall surface and arranged at interval, the buckle hole being formed between the two clamping plates; and the face frame or the air duct assembly further includes two support platforms arranged at interval, the buckle being connected between top ends of the two support platforms.

6. The indoor unit according to claim 5, wherein:

the two clamping plates both have a plate shape and are parallel to each other;

a first clamping plate of the two clamping plates includes a first surface facing a second clamping plate of the two clamping plates and including a first groove;

the second clamping plate includes a second surface facing the first clamping plate and including a second groove; and the first groove and the second groove cooperate with each other to form the buckle hole.

7. The indoor unit according to claim 1, wherein:

a first side of the lower panel is connected with the edge of the opening at a first side of the opening or an edge of the air duct assembly at a first side of the air duct assembly by a screw; and a second side of the lower panel opposite to the first side of the lower panel is connected with the edge of the opening at a second side of the opening opposite to the first side of the opening or the edge of the air duct assembly at a second side of the air duct assembly opposite to the first side of the air duct assembly by slot-plug fit.

8. The indoor unit according to claim 7, wherein:

the lower panel further includes a first bolt hole at an inner wall surface of one of the first side and the second side of the lower panel, the first bolt hole being configured to allow a locking member to penetrate through; and the face frame includes a column protruding towards the lower panel and including a second bolt hole configured to allow the locking member to penetrate through.

9. The indoor unit according to claim 7, wherein:

the lower panel further includes an insertion member protruding from an inner wall surface near one of the first side and the second side of the lower panel, the insertion member inclining towards the one of the first side and the second side of the lower panel, and an end of the insertion member bending towards the one of the first side and the second side of the lower panel;

the edge of the opening includes an insertion hole extending in a first direction from the first side of the opening to the second side of the opening; and the insertion member is configured to be inserted in the insertion hole to limit the lower panel from moving along a second direction perpendicular to the first direction.

10. The indoor unit according to claim 1, wherein:

one of a first middle portion of the lower panel and a second middle portion of the edge of the opening includes a clamping hole, and another one of the first middle portion and the second middle portion includes a fastener matching the clamping hole; or one of the first middle portion and the second middle portion includes a buckle, and another one of the first middle portion and the second middle portion includes a buckle hole matching the buckle.

11. The indoor unit according to claim 10, wherein:

the first middle portion includes the clamping hole and the second middle portion includes the fastener;

the lower panel further includes two vertical plates protruding from the first middle portion and facing each other to form the clamping hole;

the edge of the opening further includes a clamping groove at the second middle portion, the fastener having a bar shape and being connected to a sidewall of the clamping groove; and the two vertical plates are configured to be fitted in the clamping groove and the fastener is configured to be clamped in the clamping hole.

12. The indoor unit according to claim 1, wherein:

the lower panel further includes a plurality of first screw holes at a periphery of the air outlet each configured to allow one of a plurality of locking members to penetrate through; and the air duct assembly includes a plurality of second screw holes each configured to allow one of the plurality of locking members to penetrate through.

13. The indoor unit according to claim 1, wherein:

the housing further includes a chassis connected to the face frame;

wherein a side of the lower panel abuts against the chassis or is coplanar with an outer wall surface of the chassis.

14. The indoor unit according to claim 1, further comprising:

a heat exchanger mounted in the housing; and wherein:

the housing further includes a chassis connected to the face frame the connector of the refrigerant pipe is further configured to be exposed through the opening.

15. The indoor unit according to claim 1, wherein:

the lower panel further includes a first locking structure at the periphery of the avoiding hole;

the cover plate includes a second locking structure at an inner sidewall of the cover plate; and the cover plate is detachably connected to the periphery of the avoiding hole through the first locking structure and the second locking structure.

16. The indoor unit according to claim 1, further comprising:

an upper panel, a side of the upper panel being rotatably connected with a side of the face frame, and another side of the upper panel being snap-fitted with the lower panel.

17. The indoor unit according to claim 16, wherein:

the upper panel is configured to cover a mounting opening of the face frame; and/or an inner side surface of the upper panel includes a first clamping member having a slot shape, an outer sidewall of the lower panel includes a second clamping member in a hook shape, and the upper panel is connected with the lower panel through the first clamping member and the second clamping member.

18. The indoor unit according to claim 1, further comprising:

an air guiding assembly;

wherein:

the air guiding assembly is detachably connected with a periphery of the air outlet; or the air guiding assembly is mounted at the face frame and faces the air outlet.

19. An air conditioner, comprising:

an outdoor unit; and an indoor unit connected to the outdoor unit and including:

a housing including a face frame and a dismounting and mounting opening, an opening being formed at a lower portion of the face frame, and the dismounting and mounting opening being communicating with the opening;

an air duct assembly mounted in the housing;

a refrigerant pipe including a connector; and a lower panel including an air outlet in communication with the air duct assembly, an avoiding hole corresponding to the dismounting and mounting opening, and a cover plate detachably connected to a periphery of the avoiding hole and configured to close or open the avoiding hole and the dismounting and mounting opening;

wherein:

a periphery of the lower panel is detachably connected with an edge of the opening or the air duct assembly;

the opening is configured to expose the air duct assembly when the lower panel is opened; and the connector of the refrigerant pipe is configured to be exposed from the dismounting and mounting opening and the avoiding hole.

20. The indoor unit according to claim 1, wherein a connection between the periphery of the lower panel and the edge of the opening or an edge of the air duct assembly includes a slider-slot fit connection.

* * * * *